US006827808B2

(12) United States Patent
Fenn

(10) Patent No.: US 6,827,808 B2
(45) Date of Patent: Dec. 7, 2004

(54) METHOD AND APPARATUS FOR REMOVING TABLETS FROM BLISTER PACKS

(75) Inventor: John David Fenn, Surrey (GB)

(73) Assignee: Wright, Fenn & Co. LTD, Surrey (GB)

( * ) Notice: Subject to any disclaimer, the term of this patent is extended or adjusted under 35 U.S.C. 154(b) by 20 days.

(21) Appl. No.: 10/240,384

(22) PCT Filed: Mar. 22, 2001

(86) PCT No.: PCT/GB01/01250

§ 371 (c)(1),
(2), (4) Date: Oct. 21, 2002

(87) PCT Pub. No.: WO01/72589

PCT Pub. Date: Oct. 4, 2001

(65) Prior Publication Data

US 2003/0159774 A1 Aug. 28, 2003

(51) Int. Cl.[7] ..... B32B 35/00

(52) U.S. Cl. ..... 156/247; 156/344; 156/584; 221/82; 221/84; 221/85

(58) Field of Search ..... 156/247, 344, 156/584; 221/76, 79, 81, 82, 84, 85, 86

(56) References Cited

U.S. PATENT DOCUMENTS

| | | | | |
|---|---|---|---|---|
| 3,744,214 A | | 7/1973 | Dolce et al. | |
| 4,158,411 A | | 6/1979 | Hall et al. | |
| 4,702,788 A | | 10/1987 | Okui | |
| 5,431,283 A | * | 7/1995 | Weinstein et al. | 206/531 |
| 5,853,101 A | * | 12/1998 | Weinstein | 220/284 |
| 5,906,701 A | | 5/1999 | Smythe | |
| 6,474,500 B1 | * | 11/2002 | Carr et al. | 221/25 |

FOREIGN PATENT DOCUMENTS

EP 0 443 502 8/1991

* cited by examiner

*Primary Examiner*—Mark A. Osele
(74) *Attorney, Agent, or Firm*—Smith-Hill and Bedell

(57) ABSTRACT

An apparatus is provided for removing tablets from a blister pack including formations for receiving the tablets and a rupturable foil member which seals the formations. The foil member is rupturable to allow removal of the tablets from the blister pack. The de-blistering apparatus works essentially by using an adhesive coated tape to mount and draw the blister pack through a depressing station and a foil removal station. In the depressing station, the foil which seals the tablet within the formations is ruptured and in the foil removal station the ruptured foil is removed from the blister pack to free the tablet.

17 Claims, 3 Drawing Sheets

METHOD AND APPARATUS FOR REMOVING TABLETS FROM BLISTER PACKS

The invention relates to apparatus for removing tablets from blister packs of tablets.

Blister packs are a very common means of packaging pharmaceutical tablets and may also be used for packaging swimming pool chemicals, gardening tablets, etc. Such blister packs conventionally include a generally planar member of a plastics material, provided with a series of formations for receiving the tablets. A tablet is inserted into each of the formations, the open ends of which are sealed by means of a backing layer of aluminium foil or other breakable material, which is attached to the plastics material. Each tablet is thus sealed in its own formation until use, when the plastics formation is depressed by finger pressure and the tablet is forced out through the backing layer.

In some establishments, such as large dispensing chemists, there is a need to de-blister large numbers of blister packs of tablets, for example for storage or for making up into individual packs including all a patient's prescribed tablets. Generally, the mass de-blistering of blister packs in order to remove the tablets is done manually and shop assistants carrying out the de-blistering may damage their fingers and fingernails.

According to the present invention there is provided apparatus for removing tablets from a blister pack including a formation for receiving a tablet and a backing layer which seals the formation and is rupturable to allow removal of the tablet, the apparatus including a flexible adhesive member, means for bringing at least a part of the backing layer of the blister pack into contact with the flexible adhesive member, and means for depressing the formation to rupture the backing layer sealing the formation, when the backing layer sealing the formation is in contact with the flexible adhesive member.

Preferably the blister pack includes a plurality of formations each receiving a respective tablet. Preferably the blister pack includes a substantially planar member from which the formations protrude.

Preferably when the backing layer is bought into contact with the flexible adhesive member, the backing layer adheres to the flexible adhesive member.

Preferably means are further provided for separating the flexible adhesive member in contact with the ruptured backing layer from the associated formation, a part of the ruptured backing layer remaining in contact with the flexible adhesive member and thereby releasing the tablet.

Preferably the flexible adhesive member includes an adhesive coated tape.

The tape may have a thickness of between 0.05 mm and 0.2 mm, and preferably has a thickness of about 0.11 mm. The tape may have a breaking load of between 10 and 30 N/cm and a maximum elongation of between 110% and 130%.

Preferably the tape is a polyvinyl chloride tape.

Preferably the adhesive is a pressure sensitive adhesive. The adhesion of the tape to steel is preferably between 2.5 and 5 N/cm and most preferably about 3.6 N/cm. The adhesion of the tape to itself is preferably about 0.6 N/cm.

Preferably means are provided for conveying the blister pack on the tape between a depressing station where the formation is depressed to rupture the backing layer and a backing layer removal station where a part of the ruptured backing layer is removed from the blister pack.

Preferably the means for conveying the blister pack on the tape includes a tape collector roller which may rotate to draw the tape through the depressing station and the backing layer removal station. The tape collector roller may include a central driven rotatable member which may be between 6 mm and 12 mm in diameter. The tape collector roller preferably further includes an outer substantially cylindrical tape receiving portion which preferably has a diameter of between 60 mm and 120 mm and most preferably about 80 mm. When the central member is rotated, preferably tape is drawn onto and wrapped around the outer tape receiving portion.

Preferably tape for drawing through the depressing station and the backing layer removal station is drawn from a tape cartridge located upstream of the depressing station. The tape cartridge may comprise a roll of tape.

Preferably a carrier plate having a substantially planar upper face is located between the tape cartridge and the depressing station. The carrier plate may receive a blister pack to be de-blistered. Preferably the carrier plate includes a substantially straight edge adjacent the depressing station.

Preferably the tape passes over the carrier plate with its adhesive coated face oriented away from the plate, such that a blister pack located on the carrier plate is received on the adhesive coated face of the tape.

Preferably a guide roller is located above and spaced from the carrier plate. The guide roller may be made of a soft material for lightly pressing the blister pack against the tape. The guide roller may be freely rotatable.

The means for depressing the formation may include means for gripping an edge of the blister pack. These means may include a rotatable driven roller. The driven roller may be located at the depressing station adjacent to and slightly spaced from the edge of the carrier plate. The size of the space between the driven roller and the edge of the carrier plate is preferably adjustable.

Preferably the adhesive coated tape is drawn under the driven roller. Preferably the driven roller draws the blister pack between the roller and the tape. The driven roller may be located about 1 mm from the tape. The driven roller may have a diameter of between 6 mm and 1 mm and preferably has a diameter of about 8 mm.

Preferably as the blister pack is drawn under the driven roller, the driven roller depresses a formation of the blister pack, thereby pushing an enclosed tablet towards the flexible adhesive member and rupturing the backing layer. Preferably the rupture is at the leading edge of a part of the backing layer sealing the formation. Preferably the substantially straight edge of the carrier plate mounts and locates the blister pack during this process.

Preferably the driven roller has a non-stick outer surface.

Preferably the adhesive coated tape passes under the driven roller with its adhesive coated face oriented upwardly.

Preferably a freely rotatable roller is provided downstream of and spaced from the driven roller. Preferably the adhesive coated tape passes over the second freely rotatable roller. The freely rotatable roller is preferably located about 40 mm to 70 mm away from the driven roller. Preferably the driven and freely rotatable rollers are positioned such that the adhesive coated tape when being drawn between the two rollers is angled at between 30 and 60° to the carrier plate.

Preferably the tape collector roller is located downstream of the freely rotatable roller. The tape collector roller may be located generally under the freely rotatable roller. The tape collector roller may be located such that the adhesive coated tape when passing from the freely rotatable roller to the tape collector roller is angled at between 90° and 330° to the tape located between the driven and freely rotatable rollers.

The tape collector roller and the driven roller in the depressing station may be driven by a common drive means. The central driven rotatable member of the tape collector roller may be connected by drive means such as a chain, belt, etc., to the driven roller in the depressing station.

The backing layer removal station may be located in the region of the freely rotatable roller. The backing layer removal station may include means for guiding the blister pack away from the tape towards a tablet collection container. The tablet collection container may include a receptacle provided with an opening through which individual tablets may pass. Preferably the opening is sized/positioned such that the blister pack does not pass therethrough in normal use.

The apparatus may further include a receptacle for collecting empty blister packs, located adjacent to the tablet collection receptacle. The receptacle may include an opening through which the blister pack may pass.

According to the invention there is further provided a method for removing tablets from a blister pack including a formation for receiving the tablets and a backing layer which seals the formation and is rupturable to allow removal of the tablets, the method including the steps of bringing at least a part of the backing layer of the blister pack into contact with a flexible adhesive member and depressing the formation to rupture the backing layer sealing the formation, when the backing layer sealing the formation is in contact with the flexible adhesive member.

The method may further include the step of separating the flexible adhesive member in contact with the ruptured backing layer from the associated formation, a part of the ruptured backing layer remaining in contact with the flexible adhesive member and thereby releasing the tablet.

The flexible adhesive member may include an adhesive coated tape and the method may include the step of conveying the blister pack on the tape between a depressing station where the formation is depressed to rupture the backing layer and a backing layer removal station where a part of the ruptured backing layer is removed from the blister pack.

Means may be provided for drawing the adhesive coated tape through the depressing station and the backing layer removal station. The adhesive coated tape may be drawn over a carrier plate having a substantially planar upper face, the tape passing over the carrier plate with its adhesive coated face oriented away from the plate such that a blister pack located on the carrier plate is received on the adhesive coated face of the tape.

The method may include the step of conveying the blister pack on the adhesive coated tape from the carrier plate to the depressing station. The method may include the step of gripping an edge of the blister pack in the depressing station. The method may include the step of using a driven roller to grip an edge of the blister pack. The method may further include the step of using the driven roller to depress the formation to rupture the backing layer.

The method may further include the step of drawing the blister pack on the adhesive coated tape to the backing layer removal station, where the blister pack is guided away from the adhesive coated tape towards a tablet collection receptacle.

An embodiment of the invention will be described for the purpose of illustration only with reference to the accompanying drawings in which.

Figures 1A, 1B:
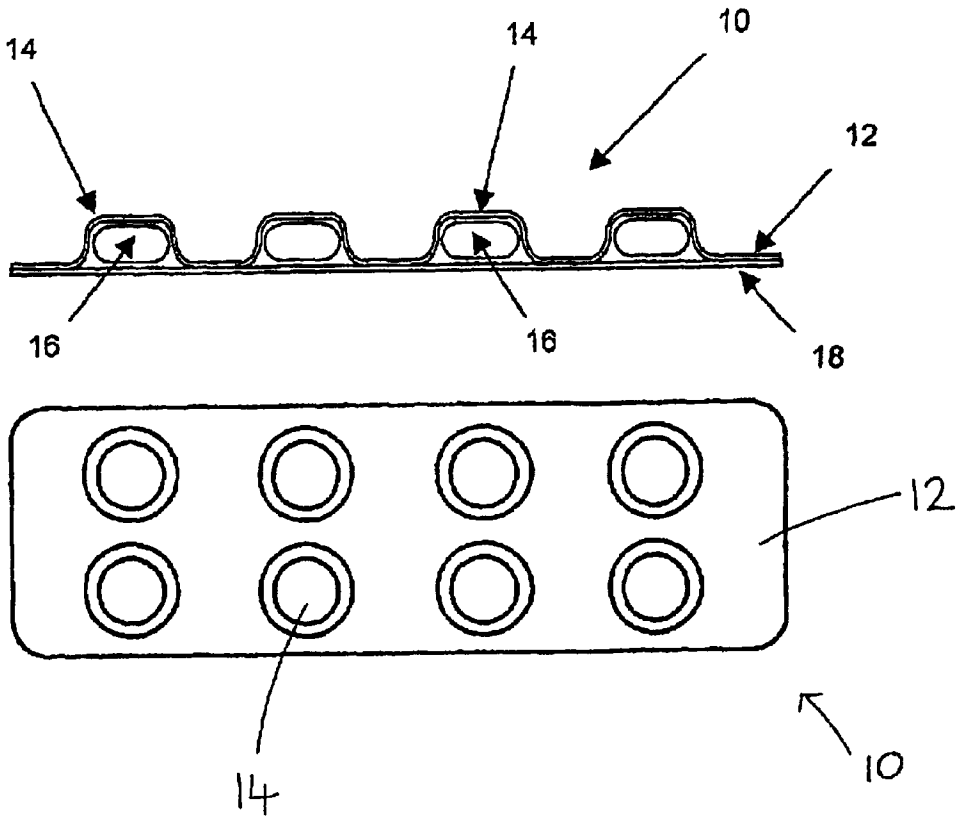
FIG. 1A is a diagrammatic cross section through a blister pack and FIG. 1B is a plan view of the blister pack of FIG. 1A.

Referring to FIGS. 1A and 1B, a blister pack 10 includes a moulded plastics member formed to include a generally planar portion 12 provided with a plurality of substantially semi-cylindrical formations 14 protruding therefrom. Within each formation 14, a tablet 16 is received. The tablets 16 are sealed within the formations 14 by a thin, rupturable foil member 18. To remove tablets 16 from the blister pack 10, the foil 18 may be ruptured, for example with a finger nail, to open up the formations 14.

Figure 2:
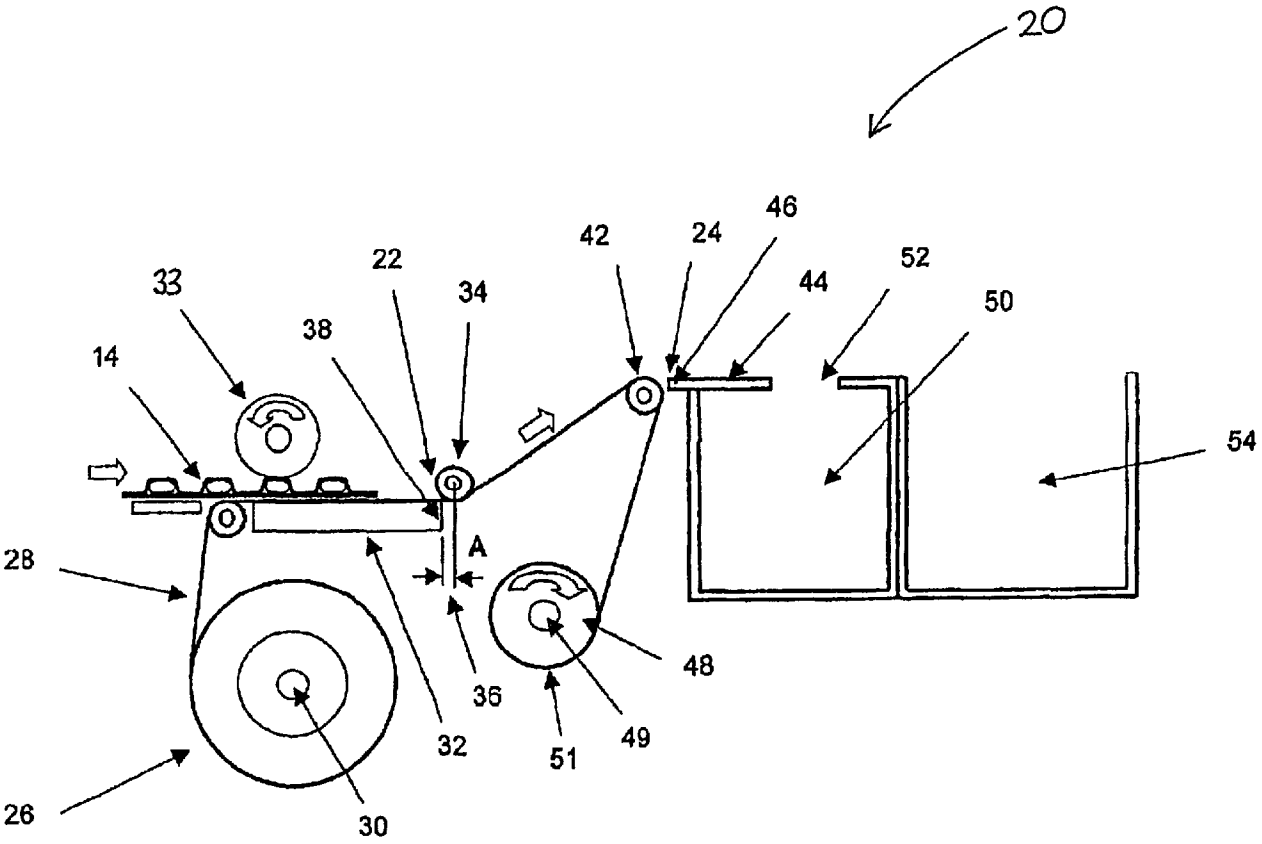
FIG. 2 is a diagrammatic sectional view of a de-blistering apparatus according to the invention.
Figure 3:
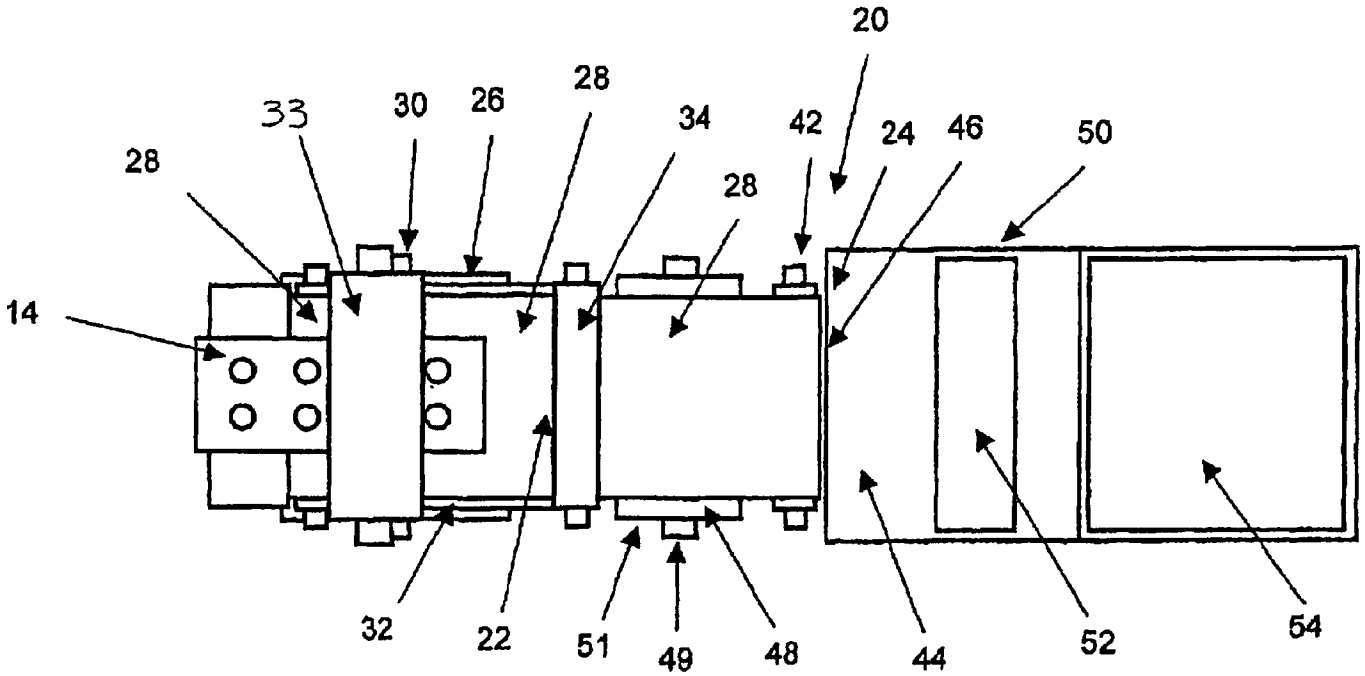
FIG. 3 is a plan view of the apparatus of FIG. 2.

FIGS. 2 and 3 illustrate a de-blistering apparatus 20 for removing tablets 16 from blister packs 10. The de-blistering apparatus 20 works essentially by using an adhesive coated tape to mount and to draw a blister pack 10 through a depressing station 22 and a foil removal station 24. In the depressing station 22 the foil 18 which seals the tablets 16 within the formations 14 is ruptured and in the foil removal station 24 the ruptured foil 18 is removed from the blister pack 10 to free the tablets 16.

At an upstream end of the de-blistering apparatus 20, there is provided a cartridge 26 of adhesive coated tape 28. The adhesive coated side of the tape 28 is located outwardly on the cartridge. The tape 28 is made of polyvinylchloride and is about 0.11 mm thick. It has a breaking load of about 20 N/cm and a maximum elongation of about 120%. The adhesion of the tape to itself is about 2.5 N/cm.

The cartridge 26 is mounted so as to be freely rotatable about an axis 30.

Downstream of the cartridge 26, there is located a substantially planar carrier plate 32. The carrier plate 32 is oriented substantially horizontally when the apparatus 20 rests on a horizontal surface. Above and spaced from the carrier plate 32 is a guide roller 33. The guide roller 33 is free running and is made of a soft material.

Adjacent to and downstream of the carrier plate 32, there is provided a blister pack drive roller 34, which has a diameter of about 8 mm and which is coated with non-stick silicon rubber. The carrier plate 32 is slidable in the direction indicated by the arrow A, in order adjust the horizontal distance 36 between a flat edge 38 of the carrier plate 32 and the centre of the blister pack drive roller 34.

The blister pack drive roller 34 may be driven to rotate in an anti-clockwise direction as viewed in FIG. 2. The function of the blister pack drive roller 34 is described in more detail hereinafter.

The flat edge 38 of the carrier plate 32 and the blister pack drive roller 34 together form the depressing station 22.

The foil removal station 24 is located downstream and somewhat above the depressing station 22. The foil removal station 24 includes a free running guide roller 42, also having a diameter of about 8 mm. Adjacent to the guide roller 42 is a platform member 44. An edge 46 of the platform member is located close to an outer radius of the guide roller, but there is a gap of about 0.5 mm therebetween.

Generally under the drive roller 34 there is provided a collector roller 48 onto which the adhesive coated tape may be wound. The collector roller 48 is driven such that it may rotate in a clockwise direction as viewed in FIG. 2, thus drawing the tape 18 from the cartridge 26. The tape 18 so drawn passes over the carrier plate 32, under the blister pack drive roller 34, over the guide roller 42 and finally onto the collector roller 48. The collector roller 48 includes a central driven member 49, having a diameter of about 8 mm, and an outer tape receiving portion 51, having a diameter of about 80 mm.

The platform member 44 forms an upper surface of a pill collection container 50 provided with an upper orifice 52, which is sized such that a typical blister pack 10 cannot pass therethrough but tablets 16 can pass therethrough.

Adjacent to the pill collection container 50, an empty pack container 54 is provided.

The apparatus works as follows. A blister pack 10 (not shown in FIG. 2) from which tablets 16 are to be removed is placed on the tape 28 on the corner plate 32. The carrier plate 32 is adjusted such that the horizontal distance 36 between the flat edge 38 of the carrier plate and the blister pack drive roller 34 is appropriate, as described in more detail below.

The collector roller 48 is driven in a clockwise direction to draw tape 28 from the cartridge 26. As the tape 28 is drawn, the blister pack 10 passes underneath the guide roller 33. The guide roller 33 is soft and presses the blister pack 10 lightly against the tape 28. In this way the best adhesion between the blister pack 10 and the tape 28 is achieved.

The blister pack drive roller 34, which may be driven by a common drive with the collector roller 48, rotates in an anti-clockwise direction. The rotation of the blister pack drive roller 34 draws an edge of the blister pack to the right as illustrated in FIG. 2, the blister pack being held between the adhesive tape 28 and the drive roller 34. As the blister pack 10 moves to the right, the drive roller 34 encounters a formation 14 in the blister pack. As the formation is drawn under the drive roller, the drive roller 34 depresses the formation 14 at its leading edge, causing the tablet 16 located within to pivot in a clockwise direction. The pivoting action of the tablet 16 linked with the tape support causes the foil 18 sealing the formation 14 to rupture. The tape is sufficiently soft that the tablet 16 may partly protrude from the blister pack when depressed, without unduly adding pressure which may damage the tablet. The non-stick surface of the drive roller ensures that the tape 28 does not stick to this roller.

The collector roller 48 continues to rotate, drawing the blister pack 10 on the tape 28 up the angled portion of tape between the depressing station 22 and the foil removal station 24. When the next formation 14 or set of formations 14 encounters the blister pack drive roller the formations 14 are depressed causing the tablets 16 to pivot as described previously and thus rupturing the associated pieces of foil 18.

The blister pack 10 subsequently encounters the foil removal station 24. The blister pack 10 is relatively stiff and cannot pass between the edge 46 of the platform member 44 and the guide roller 42. Thus, the blister pack is conveyed towards the pill collection container 50. However, the ruptured foil 18 is firmly stuck on to the tape 28. Thus, as the blister pack 10 moves towards the pill collection container 50, a portion of foil 18 adjacent to each formation 14 remains on the tape 28 and is torn from the remainder of the blister pack 10. Thus, each formation 14 is now unsealed.

The blister pack 10 subsequently passes over the orifice 52 of the pill collection container. The orifice 52 is sized such that the blister pack may not pass therethrough. However the tablets 16 now in unsealed formations 14 drop out of the blister pack into the pill collection container 50. The empty blister pack 10 is then received within the empty pack container 54.

There is thus provided a de-blistering apparatus 20 which allows for the convenient and quick removal of tablets 16 form blister packs 10. The horizontal distance 36 between the flat edge 38 of the carrier plate 32 may be adjusted to ensure that the apparatus functions for all sizes of tablets 16.

There is thus provided improved apparatus for removing tablets from blister packs. Prior art de-blistering techniques include the use of a roller to push/expel tablets fully out of the blister pack. The blister pack is mounted on a carrier, including gaps for allowing the tablets to be pushed out. Because there are very large numbers of different sizes and depths of tablets, generally an individual carrier must be made for each type of pack formation or adjustable locators or guides must be provided to allow alterations for different depths and diameters of tablets. The arrangements can prove ineffective for many types of blister packs.

The preferred apparatus and method according to the invention, as described above, virtually removes the above problems. There is no need to push the tablet out a particular depth as it is simply necessary for the foil to break. The tape also acts as a support, thus removing virtually all need for support from the carrier.

Various modifications may be made to the above described embodiment without departing from the scope of the invention. For example, it is not essential that the tape 28 passes over the carrier plate 32. A tape cartridge could be located generally underneath the blister pack drive roller 34, such that the blister pack only comes into contact with the tape as the drive roller depresses a formation to rupture the foil 18. The drive roller 34 may be driven independently of the collector roller 48. The sizes, shapes and general arrangement of the components may be varied.

The carrier plate 32 may be heated to increase adhesive "grab". The tape may be heated by some other means, or pre-heated, to produce an equivalent effect. The aluminium foil of the blister packs may additionally or alternatively be pre-treated to increase adhesion with the tape 28. For example, isopropylalcohol could be applied via a spray or via a soft roller before the pack is presented to the machine, or corona treatment could be used The carrier plate 32 may comprise one of a set of three or more alternative blocks (small, medium and large), that may be used to vary the height of the planar surface to adjust the apparatus for different sizes of tablet.

The drive roller 34 may be mounted on a hinged support such that it may be pivoted between the position shown in FIG. 2 and a higher position which allows for ease of mounting the tape.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. Apparatus for removing tablets from a blister pack including a formation for receiving a tablet and a backing layer which seals the formation and is rupturable to allow removal of the tablet, the apparatus including a flexible adhesive member, means for bringing at least a part of the backing layer of the blister pack into contact with the flexible adhesive member, and means for depressing the formation to rupture the backing layer sealing the formation, when the backing layer sealing the formation is in contact with the flexible adhesive member.

2. Apparatus according to claim 1, wherein the blister pack includes a plurality of formations each receiving a respective tablet and a substantially planar member from which the formations protrude.

3. Apparatus according to claim 2, wherein when the backing layer is bought into contact with the flexible adhesive member, the backing layer adheres to the flexible adhesive member, and wherein means are further provided for separating the flexible adhesive member in contact with the ruptured backing layer from the associated formation, a part of the ruptured backing layer remaining in contact with the flexible adhesive member and thereby releasing the tablet.

4. Apparatus according to claim 1, wherein the flexible adhesive member includes an adhesive coated tape.

5. Apparatus according to claim 4, wherein means are provided for conveying the blister pack on the tape between a depressing station where the formation is depressed to rupture the backing layer and a backing layer removal station where a part of the ruptured backing layer is removed from the blister pack.

6. Apparatus according to claim 5, wherein the means for conveying the blister pack on the tape includes a tape collector roller which rotates to draw the tape through the depressing station and the backing layer removal station and wherein tape for drawing through the depressing station and the backing layer removal station is drawn from a tape cartridge located upstream of the depressing station and a carrier plate having a substantially planar upper face is located between the tape cartridge and the depressing station.

7. Apparatus according to claim 6, wherein the carrier plate includes a substantially straight edge adjacent the depressing station, and wherein the tape passes over the carrier plate with its adhesive coated face oriented away from the plate, such that a blister pack located on the carrier plate is received on the adhesive coated face of the tape.

8. Apparatus according to claim 7, the means for depressing the formation include means for gripping an edge of the blister pack.

9. Apparatus according to claim 8, wherein the driven roller is located at the depressing station adjacent to and slightly spaced from the edge of the carrier plate, and the size of the space between the driven roller and the edge of the carrier plate is adjustable.

10. Apparatus according to claim 9, wherein the driven roller draws the blister pack between the roller and the tape, and as the blister pack is drawn under the driven roller, the driven roller depresses a formation of the blister pack, thereby pushing an enclosed tablet towards the flexible adhesive member and rupturing the backing layer.

11. Apparatus according to claim 10, wherein a freely rotatable roller is provided downstream of and spaced from the driven roller, the adhesive coated tape passing over the freely rotatable roller, and the freely rotatable roller and the driven roller being positioned such that the adhesive coated tape when being drawn between the two rollers is angled at between 30 and 60° to the carrier plate.

12. Apparatus according to claim 11, wherein the backing layer removal station includes means for guiding the blister pack away from the tape towards a tablet collection container including a receptacle, provided with an opening through which individual tablets may pass.

13. A method for removing tablets from a blister pack including a formation for receiving the tablets and a backing layer which seals the formation and is rupturable to allow removal of the tablets, the method including the steps of bringing at least a part of the backing layer of the blister pack into contact with a flexible adhesive member and depressing the formation to rupture the backing layer sealing the formation, when the backing layer sealing the formation is in contact with the flexible adhesive member.

14. A method according to claim 13, wherein the method further includes the step of separating the flexible adhesive member in contact with the ruptured backing layer from the associated formation, a part of the ruptured backing layer remaining, in contact with the flexible adhesive member and thereby releasing the tablet.

15. A method according to claim 14, wherein the flexible adhesive member includes an adhesive coated tape.

16. A method according to claim 15, wherein the method includes the step of conveying the blister pack on the tape between a depressing station where the formation is depressed to rupture the backing layer and a backing layer removal station where a part of the ruptured backing layer is removed from the blister pack.

17. A method according to claim 16, wherein the method includes the step of gripping an edge of the blister pack in the depressing station.

* * * * *